US008245776B2

(12) United States Patent
Gette et al.

(10) Patent No.: US 8,245,776 B2
(45) Date of Patent: Aug. 21, 2012

(54) WELLHEAD SYSTEM HAVING WICKER SEALING SURFACE

(75) Inventors: Nicholas P. Gette, Houston, TX (US); Daniel W. Fish, Magnolia, TX (US)

(73) Assignee: Vetco Gray Inc., Houston, TX (US)

( * ) Notice: Subject to any disclaimer, the term of this patent is extended or adjusted under 35 U.S.C. 154(b) by 136 days.

(21) Appl. No.: 12/582,221

(22) Filed: Oct. 20, 2009

(65) Prior Publication Data

US 2011/0088893 A1 Apr. 21, 2011

(51) Int. Cl.
*E21B 23/00* (2006.01)

(52) U.S. Cl. ..... 166/195; 166/89.1; 277/337

(58) Field of Classification Search ..... 166/368, 166/75.13, 75.14, 88.3, 89.1, 379, 195; 277/337, 277/339

See application file for complete search history.

(56) References Cited

U.S. PATENT DOCUMENTS

| | | | | |
|---|---|---|---|---|
| 313,915 | A | 3/1885 | Bole | |
| 4,595,053 | A | 6/1986 | Watkins et al. | |
| 4,911,245 | A | 3/1990 | Adamek et al. | |
| 4,960,172 | A * | 10/1990 | Nelson | 166/208 |
| 5,067,734 | A * | 11/1991 | Boehm, Jr. | 277/328 |
| 5,327,965 | A | 7/1994 | Stephen et al. | |
| 5,456,314 | A | 10/1995 | Boehm, Jr. et al. | |
| 5,464,063 | A | 11/1995 | Boehm, Jr. | |
| 5,469,919 | A | 11/1995 | Carisella | |
| 5,685,369 | A | 11/1997 | Ellis et al. | |
| 5,755,287 | A | 5/1998 | Cain et al. | |
| 6,403,235 | B1 | 6/2002 | Glidden et al. | |
| 6,843,480 | B2 | 1/2005 | Nelson et al. | |
| 6,915,856 | B2 | 7/2005 | Gentry et al. | |
| 7,025,360 | B2 * | 4/2006 | Walker et al. | 277/652 |
| 7,284,310 | B2 | 10/2007 | Jones et al. | |
| 7,490,676 | B2 | 2/2009 | Nobileau | |
| 2008/0078081 | A1 | 4/2008 | Huff et al. | |
| 2008/0105340 | A1 | 5/2008 | Huff et al. | |
| 2008/0105341 | A1 | 5/2008 | Huff et al. | |

* cited by examiner

*Primary Examiner* — William P Neuder
(74) *Attorney, Agent, or Firm* — Bracewell & Giuliani LLP

(57) ABSTRACT

A wellhead system comprising an outer wellhead housing, an inner wellhead member, and an annulus therebetween. The inner wellhead member, such as a casing hanger, is adapted to land in the outer wellhead housing. The outer wellhead housing may comprise a wickers formed in a hardened metal inlay. Alternatively, or in addition to the wickers formed in the outer wellhead housing, wickers may be formed in a hardened metal inlay in the inner wellhead member. An annular metal seal may be disposed in the annulus and driven into the wickers to seal the annulus between the inner wellhead member and the outer wellhead housing and to axially restrain the seal within the annulus.

20 Claims, 3 Drawing Sheets

WELLHEAD SYSTEM HAVING WICKER SEALING SURFACE

BACKGROUND OF THE INVENTION

1. Field of the Invention

The present invention relates in general to a method and apparatus to form a high pressure seal between two wellbore members, and in particular to wickers and an annular sealing ring having an increased rated working pressure.

2. Brief Description of Related Art

In hydrocarbon production wells, a wellhead housing is located at the upper end of the well. The wellhead housing is a large tubular member having an axial bore extending through it. Casing will extend into the well and will be cemented in place. A casing hanger, which is on the upper end of the casing, will land within the wellhead housing. The exterior of the casing hanger is spaced from the bore of the wellhead housing by an annular clearance which provides a pocket for receiving an annulus seal.

There are many types of annulus seals, including rubber, rubber combined with metal, and metal-to-metal. One metal-to-metal seal in use has a U-shape, having inner and outer walls or legs separated from each other by an annular clearance. An energizing ring, which has smooth inner and outer diameters, is pressed into this clearance to force the legs apart to seal in engagement with the bore and with the exterior of the casing hanger.

Some annular seals utilize wickers. Wickers may be located on the exterior of the casing hanger, in the bore of the wellhead housing, or both. The outer leg of the seal embeds into the wickers of the bore while the inner leg of the seal embeds into the wickers of the casing hanger. This locks the annulus seal in place, providing axial restraint, as well as forming a seal.

The sealing wickers are machined directly into the bore of the high pressure housing and landing subs or the neck of the casing hangers. The annulus seal is made of a sufficiently deformable metal to allow it to deform against the wickers of the casing hanger. The deformation occurs as the wickers "bite" into the annulus seal. In order to cause the seal to deform without damaging the wickers, the annulus seal is made of a metal that is softer than the steel used for the casing hangers.

SUMMARY OF THE INVENTION

Various embodiments of this invention provide a seal between a wellhead housing and a casing hanger, or between other wellbore members such as a landing sub, wherein the seal is formed between wickers having a higher yield strength than the underlying material, and, in some embodiments, an annular sealing ring also having a higher yield strength than a conventional annular sealing ring.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

Figure 1:
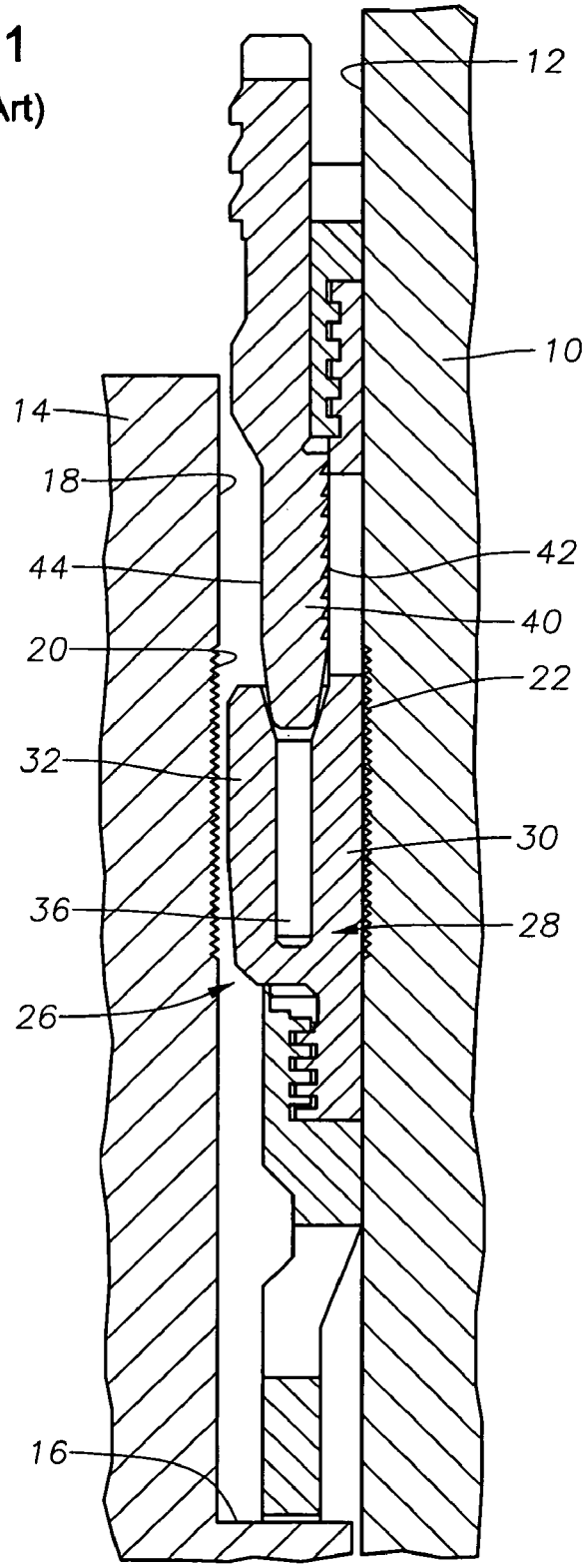
Fig. 1 (Prior Art)
FIG. 1 is a sectional view of a casing hanger, wellhead housing, seal, and energizing ring.

Referring to FIG. 1, a wellhead housing 10 is presented. In the illustrated embodiment, the wellhead housing 10 is a conventional high pressure housing for a subsea well. It is a large tubular member located at the upper end of a well, such as a subsea well. Wellhead housing 10 has an axial bore 12 extending through it. A casing hanger 14 lands in the wellhead housing 10. Casing hanger 14 is a tubular conduit secured to the upper end of a string of casing (not shown). Casing hanger 14 has an upward facing shoulder 16 on its exterior. The exterior wall 18 of casing hanger 14 is parallel to the wall of bore 12 but spaced inwardly. This results in an annular pocket or clearance between casing hanger exterior wall 18 and bore 12. A set of wickers 20 is located on the exterior wall 18 of casing hanger 14. A similar set of wickers 22 is located radially across on bore 12. Wickers 20, 22 are grooves defined by parallel circumferential ridges and valleys. They are not threads.

A seal assembly 26 lands in the pocket between casing hanger exterior wall 18 and bore wall 12. Seal assembly 26 may be made up entirely of metal components. These components may include a generally U-shaped seal member 28. Seal member 28 has an outer wall or leg 30 and a parallel inner wall or leg 32, the legs 30, 32 being connected together at the bottom by a base and open at the top. The inner diameter of outer leg 30 is radially spaced outward from the outer diameter of inner leg 32. This results in an annular clearance 36 between legs 30, 32. The inner diameter and the outer diameter are smooth cylindrical surfaces parallel with each other. Similarly, the inner diameter of inner leg 32 and the outer diameter of outer leg 30 are smooth, cylindrical, parallel surfaces.

An energizing ring 40 is employed to force legs 30, 32 radially apart from each other and into sealing engagement with wickers 20, 22. The wickers 20, 22 bite into the inner leg 30 and outer leg 32, respectively, of the seal assembly 26 as the energizing ring 40 forces the legs 30, 32 against the wickers 20, 22. Energizing ring 40 has an outer diameter 42 that will frictionally engage the inner diameter of outer leg 30. Energizing ring 40 has an inner diameter 44 that will frictionally engage the outer diameter of inner leg 32. The radial thickness of energizing ring 40 is greater than the initial radial dimension of the clearance 36.

Figure 2:
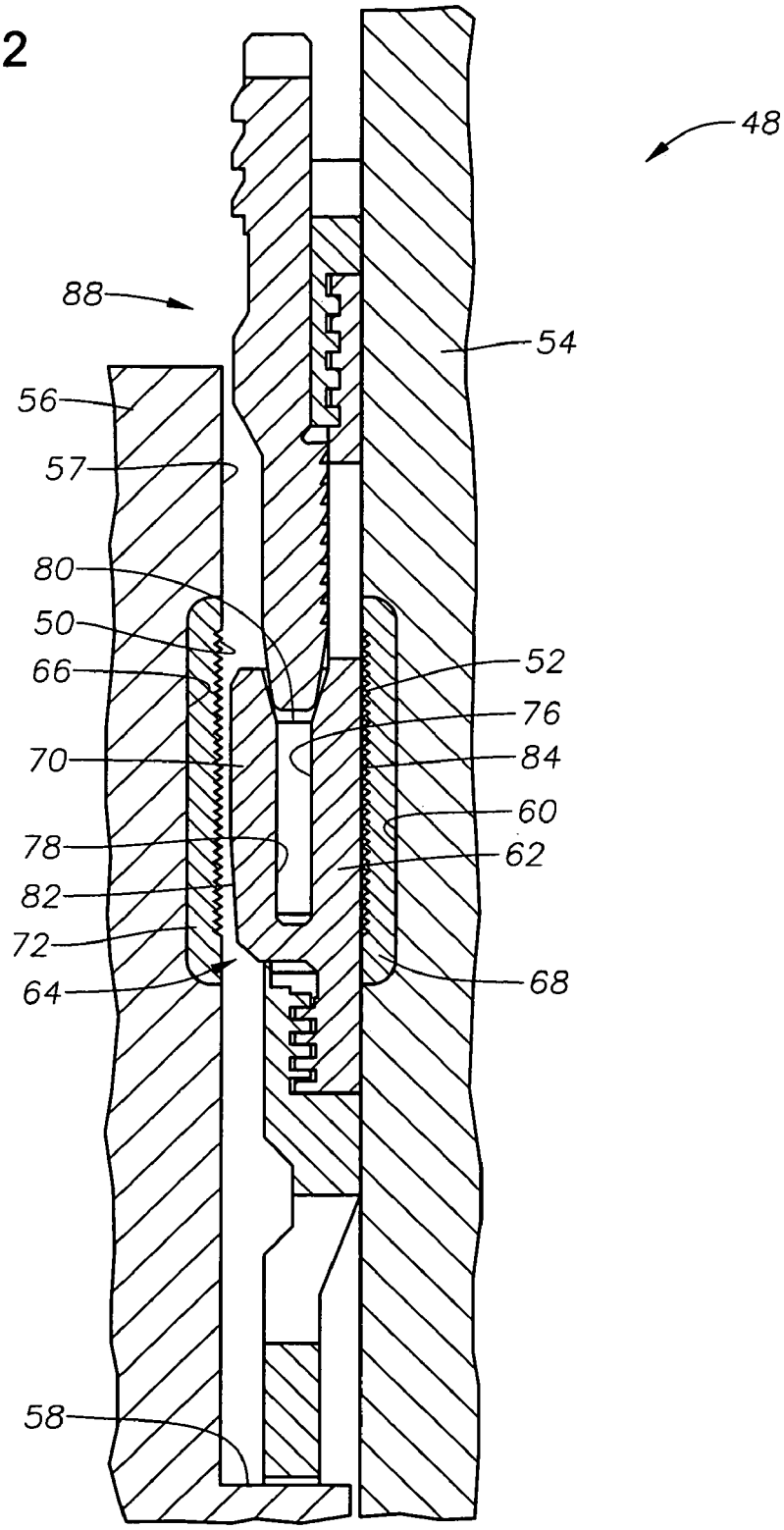
FIG. 2 is a sectional view showing an exemplary embodiment of a casing hanger with a hardened wicker inlay and a seal.

Referring to FIG. 2, an embodiment of a wellhead system 48 utilizing high strength wickers 50, 52 to seal and secure wellhead members is presented. In the illustrated embodiment, the high strength wickers 50, 52 are located on the casing hanger 56 and high pressure housing 54, respectively. However, the high strength wickers may be located on other components, or on only one of these components. Casing hanger 56 can include exterior wall 57 and upward facing shoulder 58.

In the illustrated embodiment, the high strength wickers 50, 52 are formed in an inlay material deposited on casing hanger 56 and the high pressure housing 54, respectively. In this embodiment, an elongated groove 60 is formed on the bore of high pressure housing 54. Elongated groove 60 may have an axial length that is longer than the axial length of outer leg 62 of seal member 64. In an exemplary embodiment, elongated groove 60 has an axial length of roughly 3.5 inches. However, the axial length may be longer or shorter. In the illustrated embodiment, elongated groove 60 is filled with inlay 68, which is made of a material having a yield strength and a hardness greater than the yield strength and hardness of high pressure housing 54. In this embodiment, the yield strength and hardness of inlay 68 are also greater than the yield strength and the hardness of seal member 64. Similarly, an elongated groove 66 is formed on an outer diameter of casing hanger 56. Elongated groove 66 is filled with inlay 72, which is made of a material having a yield strength and a hardness greater than the yield strength and hardness of casing hanger 56. In this embodiment, the yield strength and hardness of inlay 72 are also greater than the yield strength and hardness of seal member 64. Casing hanger elongated groove 66 may have an axial length that is longer than the axial length of inner leg 70 of seal member 64. In an exemplary embodiment, casing hanger elongated groove 66 has an axial length of roughly 3.5 inches. However, the axial length may be longer or shorter.

In the illustrated embodiment, high pressure housing 54 and casing hanger 56 are comprised of 8630-modified low alloy steel. The 8630-modified low alloy steel has a yield strength of, approximately, 80 ksi. The standard for materials used in corrosive environments in oil and gas production is NACE (National Association of Corrosion Engineers) standard "MR 0175", entitled: "Petroleum and natural gas industries-Materials for use in $H_2S$-containing environments in oil and gas production." For corrosion protection, NACE standard MR 0175 limits the hardness of 8630-modified low alloy steel for use in corrosive environments in oil and gas production to a hardness of 22 Rockwell C ("HRC").

Inlays 68, 72 may be made from a high strength alloy, such as a nickel alloy. In some embodiments, inlays 72 and 68 are made from an austenitic nickel-chromium-based alloy such as nickel alloy 725 (UNS N07725). In an exemplary embodiment, the high strength alloy used for inlays 72 and 68 has a yield strength of 120-130 ksi. The hardness of the inlay varies depending on the type of inlay material and the subsequent treatments such as heat treating. The hardness can be between roughly less than 20 HRC to greater than roughly 37 HRC. Preferably, the hardness is at least approximately 22 HRC. In some embodiments, the inlay hardness may be roughly 27-29 HRC. The greater hardness of the wickers 50, 52 formed in inlays 68, 72 enables them to bite into the seal to a greater degree than similar wickers made of 8630-modified low alloy steel. Thus, producing a better seal. The higher yield strength of the wickers 50, 52 formed in inlays 68, 72 enables them to restrain axial movement of the seal to a greater degree than similar wickers made of 8630-modified low alloy steel.

Inlay 72, 68 may be formed by a variety of manufacturing techniques. In an exemplary embodiment, inlays 72, 68 are formed by welding the inlay material onto the surface of elongated grooves 66, 60. A welder may, for example, make multiple passes to fill grooves 66, 60 with a weld bead. Other forms of deposition may be used. The radial thickness of inlays 72, 68 may be any thickness including, for example, roughly 0.125 inches to 0.5 inches.

After inlay 72, 68 is created, each inlay surface is machined to form wickers 50, 52. Wickers 50 are a series of parallel grooves on the surface of inlay 72. Wickers 52 are a series of parallel grooves on the surface of inlay 68. Each groove is defined by a valley having two sides, the sides of two adjacent valleys forming a ridge. The sides of an individual valley may have the same pitch or may have different pitches.

After depositing inlay 72, 68 material and/or after machining wickers 50, 52, the inlay material may be heat treated. Heat treating may be used to relieve residual stress present in the inlay as a result of the heating and cooling process that occurs during the inlay deposition process. In some embodiments, stress-relief heat treatments are used to relieve stress in the inlay but not to substantially alter the as-deposited hardness of the inlay. In these exemplary embodiments, the inlay material is left in its "soft," or annealed, state, which still has a greater hardness than the hardness of 33 ksi plain carbon steel. Some nickel alloys become harder as a result of heat treatment at temperatures and for durations beyond stress-relief heat treatment. Additional heat treating of inlays 72 and 68 may be used to harden, or "age," the inlay material to a higher hardness than the "soft" state. The increased hardness may cause increased brittleness in the bond between the inlays 72, 68 and the surface of the elongated grooves 66, 60. In an exemplary embodiment, inlay 72, 68 are heat treated for approximately four hours to provide stress relief after wickers 50, 52 are machined into inlay 72, 68.

In the illustrated embodiment, seal member 64 is formed from a material having a lower yield strength than the yield strength of wickers 50, 52. By using a high yield strength material for wickers 50, 52, it is possible to use a second material having a high yield strength for seal member 64, provided that the seal member 64 yield strength is lower than that of wickers 50, 52. Once energized, a seal having a higher yield strength than conventional seal member 26 would have a greater ability to resist axial movement of the seal. Seal member 64 could, for example, be made of low carbon steel having a 45 ksi minimum yield strength. Seal member 64 may, however, be made of steel having a minimum yield strength of 15 ksi.

The seal assembly comprises a generally U-shaped seal member 64. Seal member 64 has an outer wall or leg 62 and a parallel inner wall or leg 70, the legs 62, 70 being connected together at the bottom by a base and open at the top. The inner diameter 76 of outer leg 62 is radially spaced outward from the outer diameter 78 of inner leg 70. This results in an annular clearance 80 between legs 62, 70. The inner diameter 76 and the outer diameter 78 are smooth cylindrical surfaces parallel with each other. Similarly, the inner diameter of inner leg 82 and the outer diameter of outer leg 84 are smooth, cylindrical, parallel surfaces.

Figure 3:
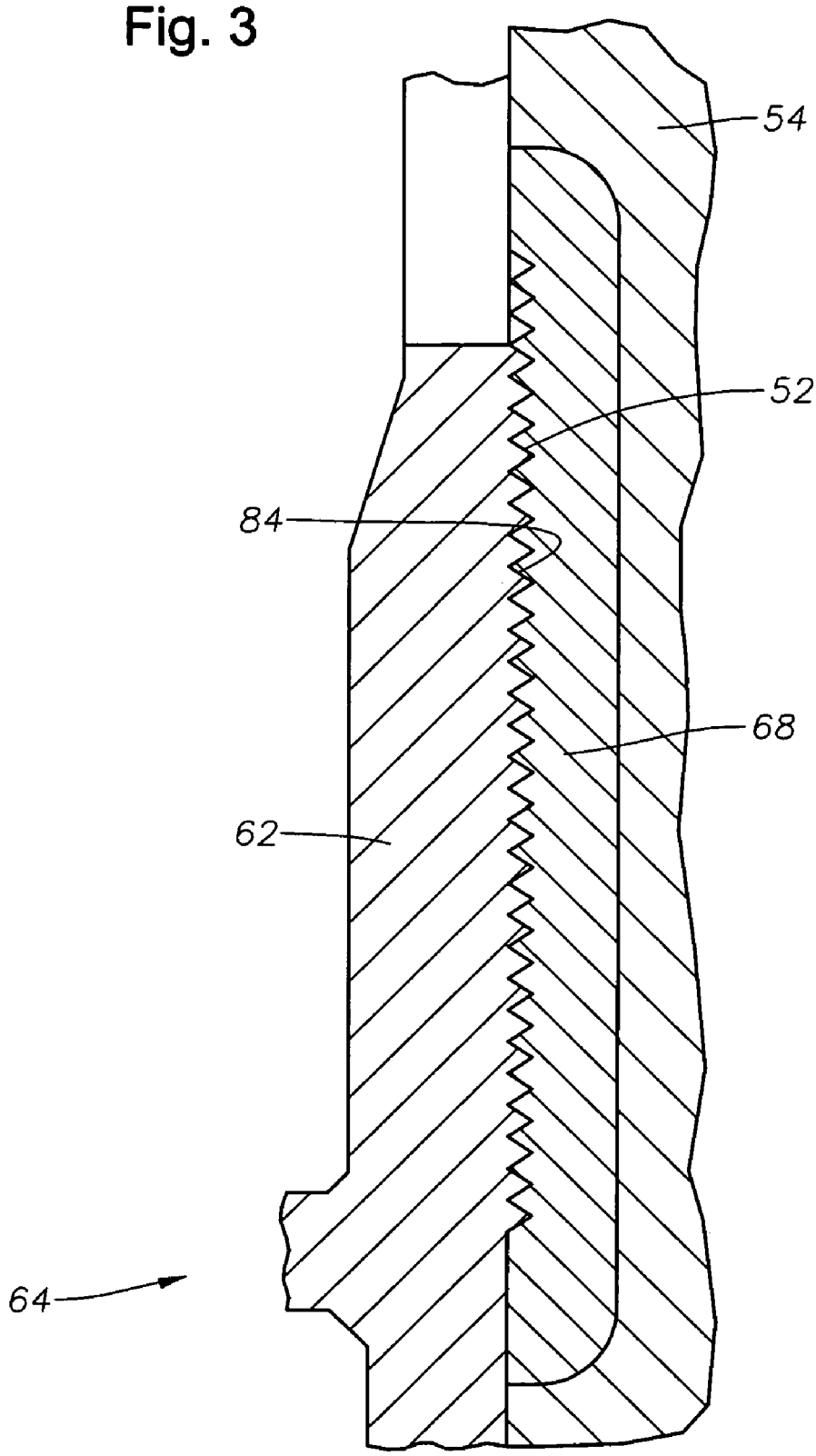
FIG. 3 is a detail view of the casing hanger and seal of FIG. 2 with the seal energized.

Referring to FIG. 3, wickers 52 are best able to form a seal when wickers 52 are able to "bite" into the surface 84 of the annular seal leg 62. As seal leg 62 is expanded into wickers 52, the surface 84 of seal leg 62 flows around wickers 52 as plastic deformation of seal leg 62 occurs. In an exemplary embodiment, the tips of the wickers 52 achieve a depth of approximately 0.030" below the surface 84 of the annular seal member 62. If the seal member 62 is made from a material that is too hard in relation to the wickers 52, the wickers 52 may deform rather than biting approximately 0.030" into the seal member 62. High strength wickers 52, such as wickers formed from nickel alloy 725, are able to bite into a high-hardness seal member 62 without deformation. Outer leg 62 is shown for illustrative purposes in FIG. 3, but the same principles apply to inner leg 70.

Referring again to FIG. 2, energizing ring 88 applies force to press the legs 62, 70 of the seal apart, causing seal legs 62, 70 engage the wickers 52, 50. Energizing ring 88 may have a wider cross-section than a conventional energizing ring 40 (FIG. 1) to create more interference with seal legs 62, 70 and thus cause increased radial contact force between the seal legs 62, 70 and the wicker sealing surface 52, 50. The increased compressive force between the seal surfaces 82, 84 and the wickers 50, 52 creates a tighter seal against wellbore pressure. If the force applied by the energizing ring 88 is too high in relation to the yield strength of the wicker material, the tips of the wickers 50, 52 may fold in response to the compressive force from the seal 64. The compressive force that causes high yield strength wickers to fail is significantly higher than the compressive force that causes conventional wickers to fail. Some embodiments use a conventional seal 28 with high strength wickers 50, 52.

A seal assembly that utilizes high strength wickers 50, 52 provides several advantages over conventional wickers. For example, a conventional seal 28 and wicker 20, 22 combination may be able to withstand a wellbore pressure of 15,000 psi. However, a high strength seal, pressed against high strength wickers with great force, may achieve a tighter seal and thus withstand a wellbore pressure of 20,000 psi, or more. In addition, objects such as a drill bit or a spinning drill string could cause damage to the sealing surfaces and wickers 50, 52. Damage to the sealing surfaces and wickers 50, 52, even minor damage, may result in an imperfect seal. A scratch may serve as a pathway for high pressure fluids and gasses to pass between the annular seal and the sealing surface. However, the high strength wickers 50, 52 are more resistant to scratches, dents, and other damage than conventional strength wickers. A material with a high yield strength, such as a 120 ksi minimum yield strength, is less likely to deform when impacted by another object such as a drill string.

While the invention has been shown or described in only some of its forms, it should be apparent to those skilled in the art that it is not so limited, but is susceptible to various changes without departing from the scope of the invention.

What is claimed is:

1. A wellhead assembly comprising:

an outer tubular wellhead member;

an inner tubular wellhead member adapted to land within the outer tubular wellhead member, defining a seal pocket between them;

an annular recess formed in at least one of the wellhead members, the annular recess having a recess surface;

an annular seal disposed within the seal pocket, the annular seal having a yield strength of at least 45 ksi;

a sealing surface located in the recess and joined to the recess surface; and a plurality of circumferentially extending, parallel ridges formed in the sealing surface, the sealing surface and the ridges comprising a material having a yield strength greater than the yield strength of the material of the wellhead member having the annular recess and greater than the yield strength of the annular seal, so that when the annular seal is urged against the sealing surface, the annular seal will deform against the ridges and the ridges will not deform against the annular seal.

2. The assembly of claim 1, wherein the yield strength of the material of the sealing surface is at least 120 ksi.

3. The assembly of claim 1, wherein the annular seal does not move in an axial direction when the wellbore pressure is 20,000 pounds per square inch.

4. The assembly of claim 1, wherein the sealing surface material comprises nickel alloy 725.

5. The assembly of claim 1, wherein the annular recess is formed on each wellhead member and the sealing surface with ridges is formed in each annular recess.

6. The assembly according to claim 1, wherein the sealing surface has a hardness of 27-29 HRC.

7. The assembly of claim 1, wherein, in response to the seal being urged toward the sealing surface, the ridges can be pressed into the annular seal to a depth of at least 0.030" without being deformed.

8. A wellhead assembly, comprising:

a wellhead housing having an axial bore;

an annular recess in the bore;

an inlay welded into the recess, the inlay having a higher yield strength than the wellhead housing;

a plurality of grooves defined by a plurality of parallel circumferential ridges and valleys formed in the inlay; and an annular metal sealing ring located in the annular recess so that, when urged against the inlay, the annular metal sealing ring forms a seal, wherein the plurality of circumferential ridges do not deform when pressing into the sealing ring by a depth of at least 0.030".

9. The assembly of claim 8, wherein the annular metal sealing ring does not move in an axial direction when the wellbore pressure is 20,000 pounds per square inch.

10. The assembly of claim 9, further comprising:

an inner wellhead member having an outer diameter;

an annular recess in the outer diameter;

a second inlay welded into the annular recess of the outer diameter, the second inlay having a higher yield strength than the wellhead housing;

a plurality of grooves defined by a second plurality of parallel circumferential ridges and valleys formed in the second inlay;

wherein the annular metal sealing ring is adapted to be pressed against the second inlay; and wherein the second plurality of grooves are adapted to deform a second surface of the annular sealing ring.

11. The assembly of claim 8, wherein the plurality of grooves have a depth less than the depth of the inlay.

12. The assembly of claim 8, wherein the yield strength of the material of the sealing surface is at least 120 ksi.

13. The assembly of claim 9, wherein the annular seal is formed from a material having a yield strength of at least 45 ksi.

14. The assembly of claim 8, wherein the material of the sealing surface has a hardness of at least 22 HRC.

15. The assembly of claim 8, wherein the material of the sealing surface has a hardness of 27-29 HRC.

16. A wellhead assembly, comprising:

a tubular outer wellhead member having an axial bore;

a tubular inner wellhead member located within the axial bore;

an annular recess formed on each of a surface in the axial bore and an exterior portion of the inner wellhead member;

an inlay welded into each of the recesses;

a plurality of concentrically extending ridges and grooves in each of the inlays;

a seal member located between the inner wellhead member and the bore, the seal member having concentric, cylindrical inner and outer walls that are embedded into the grooves of the inlays; and the inlays having a hardness greater than the hardness of the inner and outer wellhead members and greater than the hardness of the seal member so that the ridges do not deform and the seal does not move axially when subjected to a wellbore pressure of 20 ksi.

17. The assembly of claim 16, wherein the inlay and the annular sealing ring do not leak when subjected to a wellbore pressure of 20 ksi.

18. The assembly of claim 16, wherein the annular seal is formed from a material having a yield strength of at least 45 ksi.

19. The assembly of claim 16, wherein the sealing surface material comprises nickel alloy 725.

20. The assembly of claim 16, wherein the hardness of the sealing surface is at least 22 HRC.

* * * * *